US011332333B2

(12) United States Patent
Koh et al.

(10) Patent No.: US 11,332,333 B2
(45) Date of Patent: May 17, 2022

(54) SPRING KICKER ELEMENT

(71) Applicant: Hewlett-Packard Development Company, L.P., Spring, TX (US)

(72) Inventors: Seng San Koh, Singapore (SG); Fei Yuan Louisa Koh, Singapore (SG); Kok Chai Chong, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 5 days.

(21) Appl. No.: 16/958,191

(22) PCT Filed: Jan. 19, 2018

(86) PCT No.: PCT/US2018/014485

§ 371 (c)(1),
(2) Date: Jun. 26, 2020

(87) PCT Pub. No.: WO2019/143357

PCT Pub. Date: Jul. 25, 2019

(65) Prior Publication Data

US 2021/0070568 A1 Mar. 11, 2021

(51) Int. Cl.
*B65H 3/56* (2006.01)
*B65H 1/02* (2006.01)

(52) U.S. Cl.
CPC ..... *B65H 3/56* (2013.01); *B65H 1/02* (2013.01); *B65H 1/022* (2013.01); *B65H 3/565* (2013.01); *B65H 2402/544* (2013.01); *B65H 2402/5441* (2013.01); *B65H 2801/12* (2013.01)

(58) Field of Classification Search
CPC .... B65H 3/56; B65H 3/565; B65H 2402/544; B65H 2402/5441; B65H 9/106; B65H 2404/1151
See application file for complete search history.

(56) References Cited

U.S. PATENT DOCUMENTS

| | | | | |
|---|---|---|---|---|
| 6,158,733 | A | 12/2000 | Muraki | |
| 7,100,914 | B2 | 9/2006 | Ramos | |
| 7,104,539 | B2 * | 9/2006 | Shimoyama | B65H 3/0661 271/121 |
| 7,267,334 | B2 | 9/2007 | Koh | |
| 7,731,177 | B2 | 6/2010 | Ikeda | |
| 8,282,205 | B2 | 10/2012 | Choi et al. | |
| 8,439,355 | B2 | 5/2013 | Ikeda | |
| 8,511,673 | B2 * | 8/2013 | Pillard | B65H 3/063 271/121 |
| 2017/0081141 | A1 | 3/2017 | Chanclon Fernandez | |

FOREIGN PATENT DOCUMENTS

| | | |
|---|---|---|
| CN | 100589986 C | 3/2008 |

OTHER PUBLICATIONS

Xiamen Export Printing Equipment Dept ~ M2.033.571 Heidelberg SM74 Machine Separator Spring ~ 2017 ~ 4 pages https://www.aliexpress.com/store/product/.

* cited by examiner

*Primary Examiner* — Jeremy R Severson

(74) *Attorney, Agent, or Firm* — Brooks Cameron & Huebsch PLLC

(57) ABSTRACT

A spring kicker element for a kicker unit within a print device is described. In one example, the spring kicker element is fitted onto the kicker unit. The spring kicker element comprises a planar extension extending radially from its base portion, such that when fitted, the planar extension extends away from the kicker unit.

19 Claims, 8 Drawing Sheets

SPRING KICKER ELEMENT

BACKGROUND

Digital content may be rendered onto a print medium using a print device. Such print devices may store the print medium in a media tray. In operation, the print medium is gathered or picked from the media tray. The size of the media trays may differ between different print devices. As the print media, available within the media tray, is expended it may be manually replaced by the user. Print devices have evolved to increase the size of the media tray such that the print devices may now store a larger quantity of print media.

BRIEF DESCRIPTION OF THE DRAWINGS

The following detailed description references the drawings, wherein.

Figure 1:
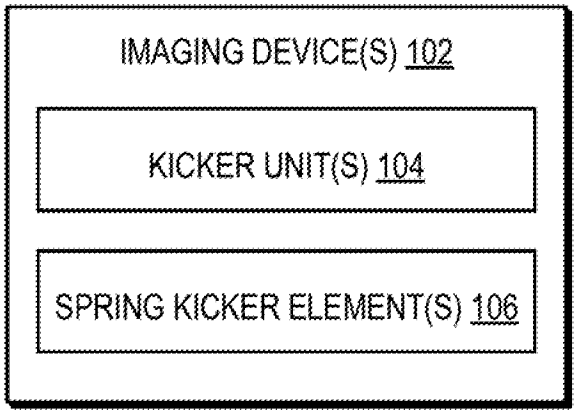
FIG. 1 is a block diagram of an imaging device as per an example of the present subject matter.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Print devices are used for rendering or printing content onto print medium. A print medium may be any substrate onto which digital content may be rendered by the print device. The print medium may be of different types and may vary in their structural properties, such as thickness, stiffness, and size. Print media may be manufactured from a variety of materials, such as paper and cardboard. The size and shape of the print medium may either be standardized or may be based on preferences of a user. Print media is most commonly rectangularly shaped. A unit of a print medium is referred to a sheet. Multiple such sheets of print media may be organized as a stack (referred to as a media stack). The media stack is maintained and stored within the media tray of the print device. During the printing operation, a sheet or unit of a print medium is picked from the media stack and processed. It is to be noted that the term sheet and piece may refer to a unit of the print medium, and be used interchangeably without deviating from the scope of the present subject matter.

The picking of the print medium is managed and controlled by a picking system. The picking system draws the print medium from the media tray and provides the same to a conveying mechanism. The conveying mechanism may then convey the picked print medium to appropriate locations within the print device for printing. At the instance when the print medium is picked, a separation system may enable picking one sheet at a time, from the media tray.

It may be the case that as the print medium is picked, the edge of the next print medium in the media stack, may get displaced. This may occur due to electrostatic charge build-up between the adjoining print media, which in turn, may result in cohesion between the print media. Therefore, when the top-most print medium is picked, it may disturb or displace the leading edge of the next print medium in the media stack. The media stack may be supported by a separator plate. In such examples, the leading edge of the print medium may abut against the separator plate, subtending a predefined angle referred to as the separator angle.

In the examples, maintaining the separator angle between the leading edges of the print media and the separator plate, reduces the possibility of multiple print media being picked at once. Therefore, the leading edge of the next print medium may get disturbed, as a result of which, the next print medium may end up at an angle which is different from the separator angle. At this instant, an example kicker unit may be activated which pushes the edge of the print medium, repositioning it. As the print medium is repositioned, its leading edge may subtend the separator angle with respect, to the separator plate.

The example kicker unit may be considered as a mechanical component with an arm and a centre portion. The arm extends radially from the centre portion. The kicker unit may be rotated about a cam shaft on which it is mounted as a result of which, the arm undergoes an angular displacement traversing an arced path. The arced path may lie in the plane which may be orthogonal to an axis about which the kicker unit moves. The cam shaft, on which the kicker unit is mounted, may be further coupled with control mechanism(s) which control the operation and movement of the kicker unit. As the arm of the kicker unit moves, it engages with the top most print medium of the media stack, and pushes the leading edge of the print medium back towards the media stack, such that the print medium subtends the separator angle with respect to the separator plate.

Recent print devices have increased capacity for storing print media, thereby resulting in an increase in the thickness of the media stack maintained by the print device. To accommodate the additional thickness, the point at which the kicker unit is pivoted, may be repositioned further away from the separator plate. The operation of the kicker unit, however, may remain unchanged. As the print device carries out numerous print operations, the print media are expended and the media stack thickness decreases. When the quantity of available print media are low (i.e., stack thickness is less), the arm of the kicker unit may not be able to reach the print medium to push its leading edge back into position.

In such instances, the extent to which the arm moves may be increased by increasing the spring strength of the control systems coupled to the kicker. Increasing the spring strength increases the angular displacement of the arm, as a result of which arm may be able to reach the media stack. However, to increase the spring strength the existing internal mechanisms of the print device may be modified or changed. Alternatively, the kicker unit may be redesigned by providing additional layers at the surface of the arm which engages with the print medium. Although such an additional layer may be able to reach the media stack, it may increase fatigue related failures of the kicker unit or the mechanism driving the kicker unit. In any case, such approaches may not benefit existing printers with increased print media capacity.

Example implementations of a print device with kicker units fitted with an example spring kicker element, are described. The example spring kicker element performs the function of the kicker unit. The spring kicker element includes a planar extension extending radially from its base. The planar extension may be further oriented with respect to the clamping arrangement, such that when fitted onto the kicker unit, the planar extension extends away from the arm of the kicker unit. As a result, the farthermost point of the planar extension is away, and separated from arm of the kicker unit. In one example, the planar extension is of an elastic material. In another example, the planar extension may be a leaf spring. The spring kicker element may be provided with a clamping arrangement at its base. The clamping arrangement allows the spring kicker element to be attached to a kicker unit. In one example, the spring kicker element may be attached at the point at which the kicker unit rotates. The clamping arrangement enables the spring kicker element to be removably coupled with or fitted onto the kicker unit of the example printer device.

When not pushing the media stack, the planar extension of the spring kicker element may not be in a compressed state. The planar extension acts as a spring, and may move from its relaxed position on engaging with the media stack. The planar extension may further include an engaging surface which touches or interfaces with the top-most print medium of the media stack. In operation, the kicker unit fitted with the spring kicker element pushes the leading edge of the print medium such that the print media is positioned and maintained at a separator angle with respect to a separator plate. When the media stack is thick, the arm urging onto the media stack may compress the spring kicker element, such that the planar extension is in a compressed state.

While in the compressed state, one surface of the planar extension abuts against the top-most print medium of the media stack, with the other surface being closer or in contact with the arm. During the print operation, the arm of the kicker unit may move between an engaging position, i.e., when the arm is contact with the media stack, and a non-engaging position, i.e., when the arm is away from the media stack to allow the print medium to be picked up. Correspondingly, the spring kicker element owing to its spring action may be between a relaxed, i.e., non-compressed state, or in a compressed state.

As the print device processes print operations, the thickness of the media stack may decrease. In such a case, when the arm moves towards the media stack, the planar extension abuts against the print medium. When the thickness of the media stack is less, the planar extension is closer to its relaxed position and away from the arm, while still being in contact with the top most print medium in the media stack. The spring kicker element continues to push against the print medium such that the print media is at the separator angle with respect to the separator plate. This reduces the instances of multiple print media picks without modifying the design of either the kicker or the machinery of the print device.

The spring kicker element may be removably coupled to the kicker unit Therefore, the spring kicker element may be retrofitted onto existing print device. In such cases, the spring kicker element may be removed and a separate spring kicker element may be installed onto the print device. As a result, it may that, the present subject matter does not add any complexity to the machinery of the print device nor causes any changes to the internal components of existing print devices.

These and other aspects are described in conjunction with various examples as illustrated in FIGS. 1-13. The present description is provided considering devices having a kicker unit assembly which is fitted with an example spring kicker element. The devices may be any imaging device which handle print media onto which content may be rendered. The rendering of content may be through a printing process undertaken by a print device or through any other process which renders content onto print media. An example of a device other than a print device, includes but is not limited to, a photocopying device.

FIG. 1 depicts a block diagram of an imaging device(s) 102. The imaging device(s) 102 may be any device which is to render content on to a print medium. Examples of such imaging device(s) 102 includes, but is not limited to, a print device or a photocopying device. It should be noted that any device which handles print media onto which content is to be rendered would be, without any limitations, included within the scope of the present subject matter. The imaging device(s) 102 may further include a kicker unit(s) 104. In certain instances, the edge of a next print medium in a media stack may get disturbed as a topmost print medium is gathered. In operation, the kicker unit(s) 104 may move and push the media edge of the next print medium which may have been disturbed. The kicker unit(s) 104 is with a centre portion and an arm. The arm is such that it radially extends from its base. The center portion of the kicker unit(s) 104 is such that it is located about an, axis about which the kicker unit is to pivot.

In one example, the kicker unit(s) 104 may be further fitted with a spring kicker element(s) 106. The spring kicker element(s) 106 may be either fitted onto the kicker unit(s) 104 at the time of manufacturing or may be retrofitted onto existing print devices, without affecting any changes to the internal mechanisms of such print devices. The spring kicker element(s) 106 includes a planar extension which extends radially from the centre portion, and away from the arm of the kicker unit(s) 104. As mentioned earlier, the kicker unit(s) 104 pushes the print medium of the media stack back to a position where it subtends an angle (referred to as the separator angle). The pushing of the print medium of the media stack is now performed by the spring kicker element(s) 106 fitted onto the kicker unit(s) 104. The spring kicker element(s) 106 is composed of an elastic material which provides the planar extension of the spring kicker element(s) 106 with spring-like properties. In one example, the spring kicker element(s) 106 may be made of a metallic material. In yet another example, the spring kicker element(s) 106 may be a leaf spring. When not in contact with the print medium, the planar extension of the spring kicker element(s) 106 is not compressed.

Owing to the elastic property of the spring kicker element(s) 106, the planar extension may act as a spring. With this, the planar extension of the spring kicker element(s) 106 moves from its relaxed position as the kicker unit(s) 104 moves towards the media stack. As the kicker unit(s) 104 approaches the media stack, the spring kicker element(s) 106 contacts the media stack and may become compressed as the kicker unit(s) 104 moves further closer to the media stack. When the thickness of the media stack is less, the media stack may be pushed back by the planar extension of the spring kicker element(s) 106. These and other aspects are further described in conjunction with remaining figures.

Figure 2:
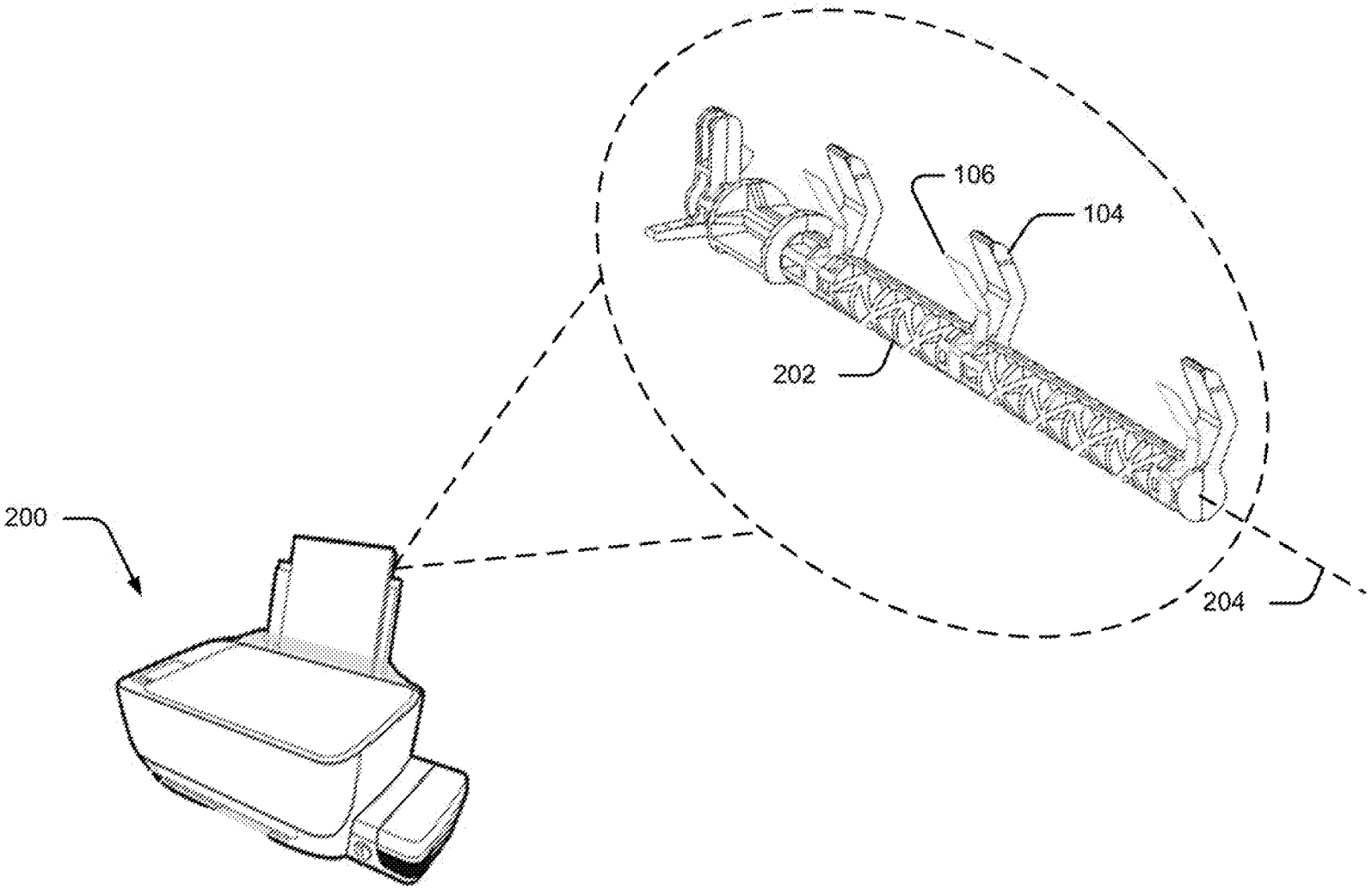
FIG. 2 is a diagram of a print device with an example kicker unit and an example spring kicker element.

As mentioned previously, the imaging device(s) 102 may include print device. FIG. 2 depicts an example print device 200 incorporating the kicker unit(s) 104 and the spring kicker element(s) 106. The, print device 200 may be, any print device which may handle and process print media by rendering digital content through a printing process. The print media within the print device 200 may be handled and conveyed through a variety of control mechanisms.

In the present example, the print device 200 includes a cam shaft 202. The cam shaft 202 is fitted with the kicker unit(s) 104. The kicker unit(s) 104 in turn is fitted with the spring kicker element(s) 106. The kicker unit(s) 104 is such that it pivots about an axis 204, which also passes through and extends along the length of the cam shaft 202. The movement of the kicker unit(s) 104 is in a plane which is orthogonal to the cam shaft 202. The movement of the cam shaft 202 enables the movement of the kicker unit(s) 104. The kicker unit(s) 104 may be further installed with the spring kicker elements) 106. In operation, the spring kicker element(s) 106 moves when the kicker unit(s) 104 is rotatably moved about the axis 204. As the spring kicker element(s) 106 moves and comes in contact with the media stack, the spring action enables it to move from the relaxed position towards the kicker unit(s) 104, and compresses it. The extent to which the spring kicker element(s) 106 compresses, i.e., moves towards the kicker unit(s) 104 is dependent on the thickness of the media stack, as will be explain in detail in conjunction with later figures.

Figure 3:
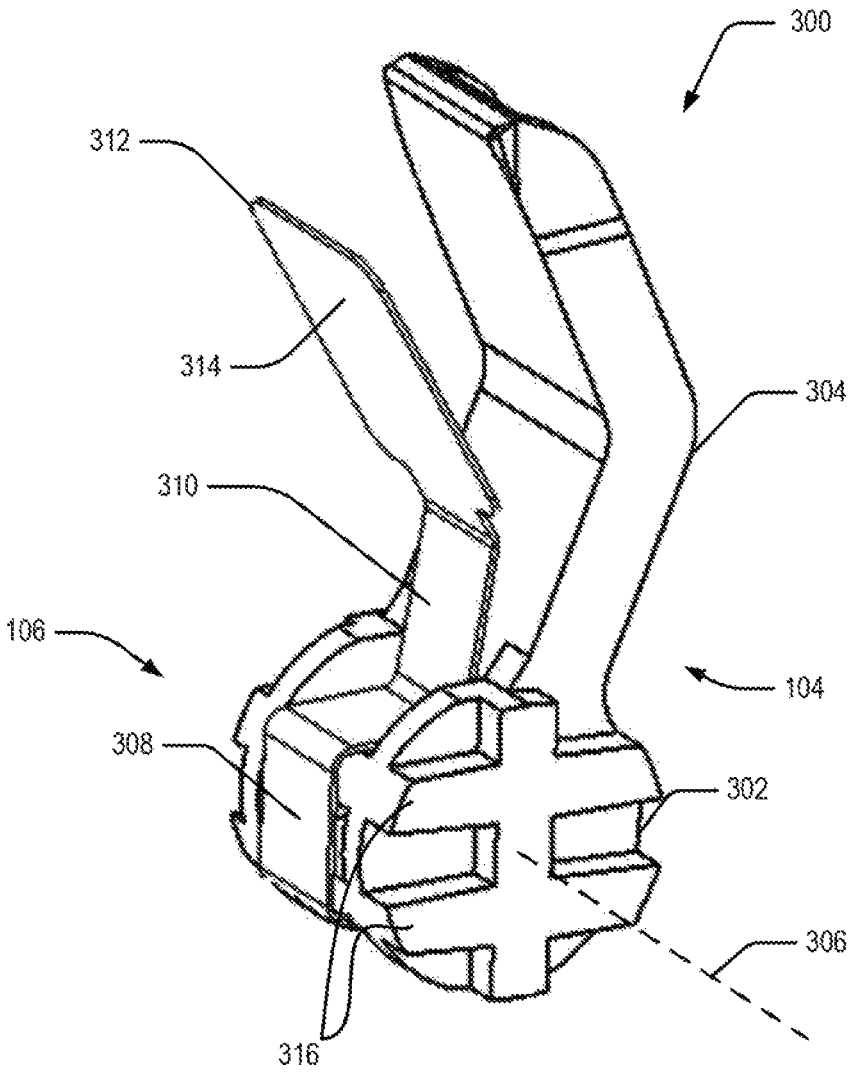
FIG. 3 is a diagram depicting a perspective view of an example kicker unit assembly.

FIG. 3 illustrates another example kicker unit assembly 300 providing a detailed description of other components included therein. The kicker unit assembly 300 includes the kicker unit(s) 104. The kicker unit(s) 104 unit includes a centre portion 302, and an arm 304 extending radially from the centre portion 302. Within the print device, such as the print device 200, the kicker unit(s) 104 is installed to move pivotably about an axis 306. When installed, the kicker unit(s) 104 may move in a plane which is orthogonal to the axis 306. The kicker unit(s) 104 is further fitted with a spring kicker element(s) 106. Once fitted, base portion 308 of the spring kicker element(s) 106 rests on the centre portion 302 of the kicker unit(s) 104 The base portion 308 of the spring kicker element(s) 106 may include be fitted onto the kicker unit(s) 104, for example through a clamping arrangement.

Besides the base portion 308, the spring kicker element(s) 106, includes an inner portion 310 which extends from the base portion 308. From the inner portion 310, a planar extension 312 further extends. The planar extension 312 also extends radially away from the base portion 308. The spring kicker element(s) 106 is so adapted such that the planar extension 312 extends away from the base portion 308 and the arm 304. In the present example, the distance between the arm 304 and the planar extension 312 continues to increase along the length of the planar extension 312. In one example, the planar extension 312 is with an engaging surface 314. In one, example, the engaging surface 314 may be flat. The engaging surface 314 engages, i.e., contacts the media stack, when the kicker unit(s) 104 moves. Although the spring kicker element(s) 106 is illustrated as comprising an inner portion 310 and the planar extension 312, the spring kicker element(s) 106 may be implemented as a plane strip which extends away from the arm 304, without deviating from the scope of the present subject matter.

In one example, the planar extension 312 is of a flexible elastic material which allows the planar extension 312 to move from a relaxed position either away or towards the arm 304, when in operation. The elastic material may be such a material which allows the planar extension 312 may move between a compressed state and a non-compressed state, as the kicker unit(s) 104 moves between an engaging position and a non-engaging position. In one example, the elastic material may be either polymeric or metallic. In another example, the spring kicker element(s) 106 may be a leaf spring made of steel. Other elastic materials may be appropriately used for manufacturing spring kicker elements) 106 without deviating from the scope of the present subject matter.

The kicker unit assembly 300 is positioned over a cam shaft, such as the cam shaft 202 within the print device 200. In such cases, the axis 306 may coincide along with the axis (i.e., axis 204) of the cam shaft 202. The centre portion 302 of the kicker unit(s) 104 may further include groove(s) 316 which allow the positioning of the kicker unit assembly 300 within a print device, such as the print device 200. In one example, the spring kicker element(s) 106 is retrofittable and may be fitted onto the kicker unit(s) 104 within existing print devices.

Figure 4:
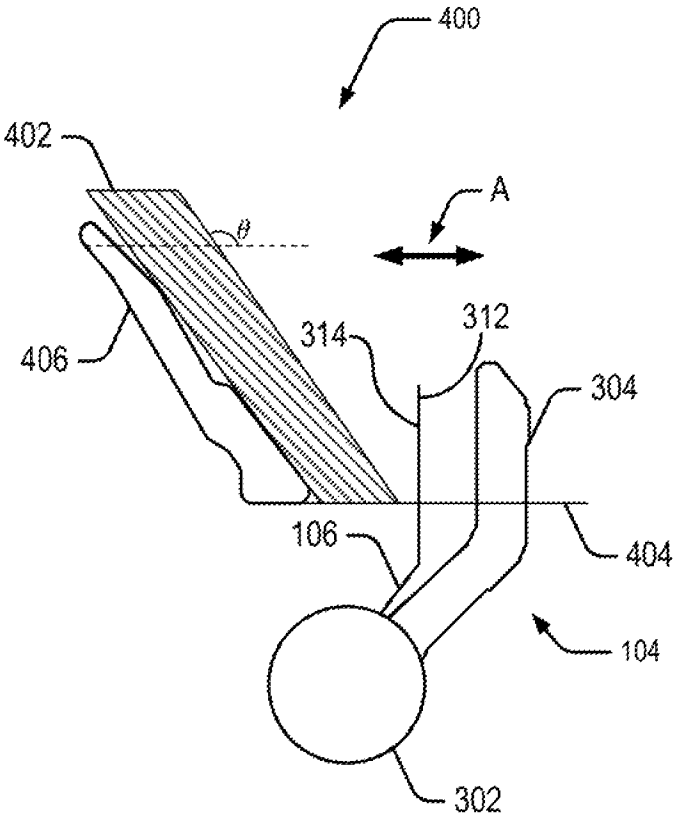

FIGS. 4-7 are various illustrations depicting the operation and the movement of the kicker unit(s) 104 fitted with the spring kicker element(s) 106. FIG. 4 illustrates an internal cross section view of the print device 400 (such as the print device 200). The print device 400 includes the kicker unit(s) 104 which is fitted with the spring kicker element(s) 106. The print device 400 may process print medium from the media stack 402. The media stack 402 is vertically supported on a support 404. The media stack 402 may further be laterally supported by the separator plate 406. The separator plate 406 enables the media stack 402 to subtend a predefined angle with respect to the support 404. The predefined angle, referred to as the separator angle θ, is such that it allows a print medium to be picked up at any instant of time.

Figure 5:
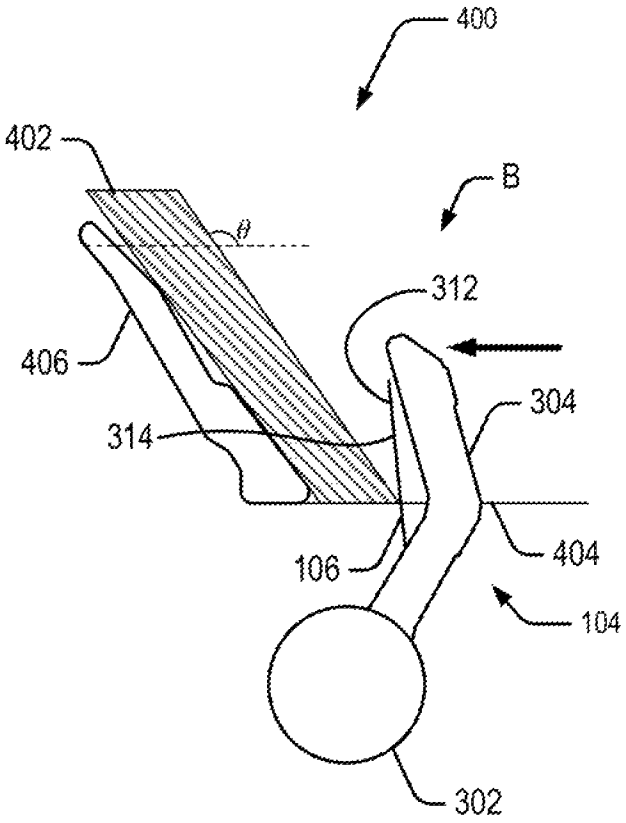
FIGS. 4-7 are diagrams depicting various stages of operation of an example kicker unit fitted with an example spring kicker element.

During any print operation, the print device may obtain a print medium from the media stack 402. When the print medium is to be picked from the media stack 402, the kicker unit(s) 104 may be in a non-engaging position as indicated by position A. At position A, the kicker unit(s) 104, and in turn the spring kicker element(s) 106, are farthest away from the media stack 402. At this position, the planar extension of the spring kicker element(s) 106, i.e., planar extension 312, is not in contact with the media stack 402. As discussed previously, due to cohesive forces (e.g., electrostatic forces) the adjoining print media may stick. As the topmost print medium is being retrieved from the media stack 402, it may happen that the next print medium may get disturbed. This may further result in a change in the position and the angle which the print media subtends with respect to the support 404 (FIGS. 4-5).

Subsequently, the kicker unit(s) 104 moves towards the media stack 402 to push the disturbed print medium. As the kicker unit(s) 104 moves closer to the media stack 402, the planar extension 312 of the spring kicker element(s) 106 comes into contact with the top most sheet of the media stack 402. In one example, the engaging surface 314 contacts the media stack, as the kicker unit(s) 104 moves towards the media stack. The engaging surface 314 may either contact the media stack 402 completely or partially depending on its thickness. The spring kicker element(s) 106 at this stage pushes the print medium against the media stack 402. The kicker unit(s) 104 may continue to move as a result of which, the spring kicker element(s) 106 may get compressed. While compressing, the engaging surface 314 of the planar extension 312 being in contact with the print medium moves closer to, and may come into contact with, the arm 304 of the kicker unit(s) 104. As shown in FIG. 5, the kicker unit(s) 104 (now at the engaging position referred to as position B) pushes the topmost print medium against the media stack 402, such that the sheets of the media stack 402 are at the separator angle θ with respect to the support 404.

Figure 7:
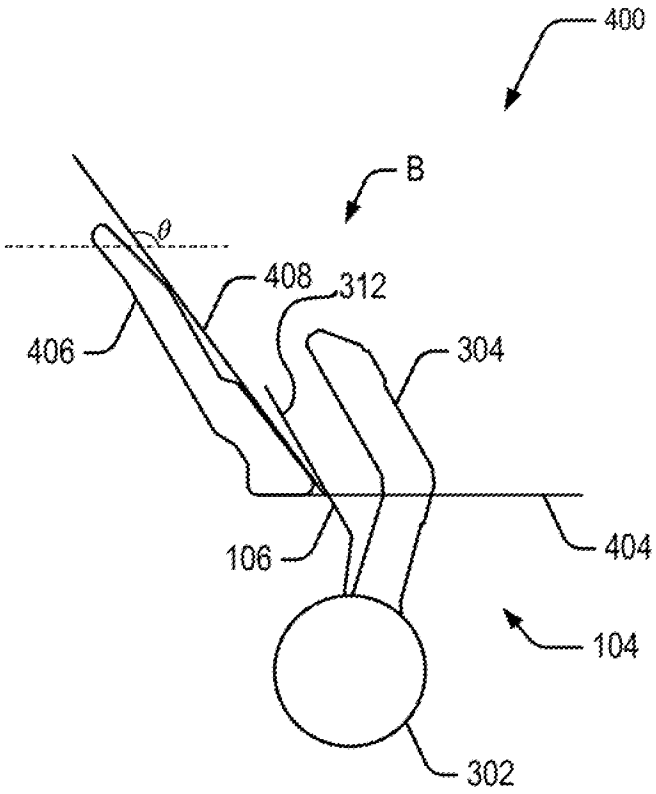
Figure 6:
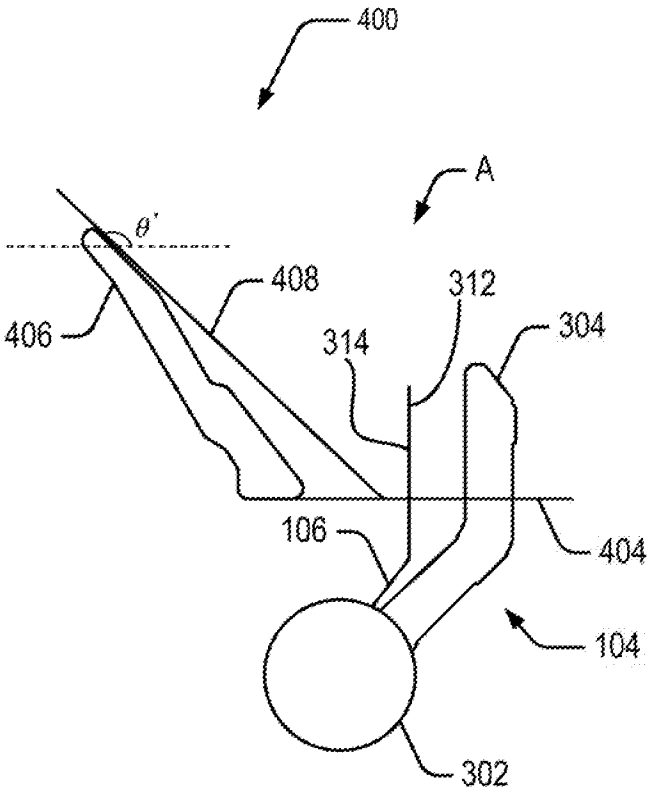

During the course of usage of the print device (such as the print device 400), the number of sheets in the media stack 402 may decrease. The kicker unit(s) 104 may continue to operate in the manner as described above, moving between the position A (i.e., the non-engaging position) and position B (engaging position). The kicker unit(s) 104 may be actuated to move the disturbed print medium 408 which now subtends an angle θ' as shown in FIG. 6. The kicker unit(s) 104 moves towards the print medium 408. As the kicker unit(s) 104 moves closer, engaging surface 314 of the planar extension 312 of the spring kicker element(s) 106 contacts and pushes the print medium 408 to a position where it subtends an angle equivalent to the separator angle with respect to the support 404, resuming its position B. Since the thickness of the media stack 402 was less, the planar extension 312 is not fully compressed, and therefore, at a distance which is greater than the distance between the planar extension 312 and the arm 304, when the media stack 402 was thicker (FIGS. 6-7). The above-mentioned process may continue as the media stack 402 is replenished and exhausted over the course of usage of the print device 400.

Figure 8:
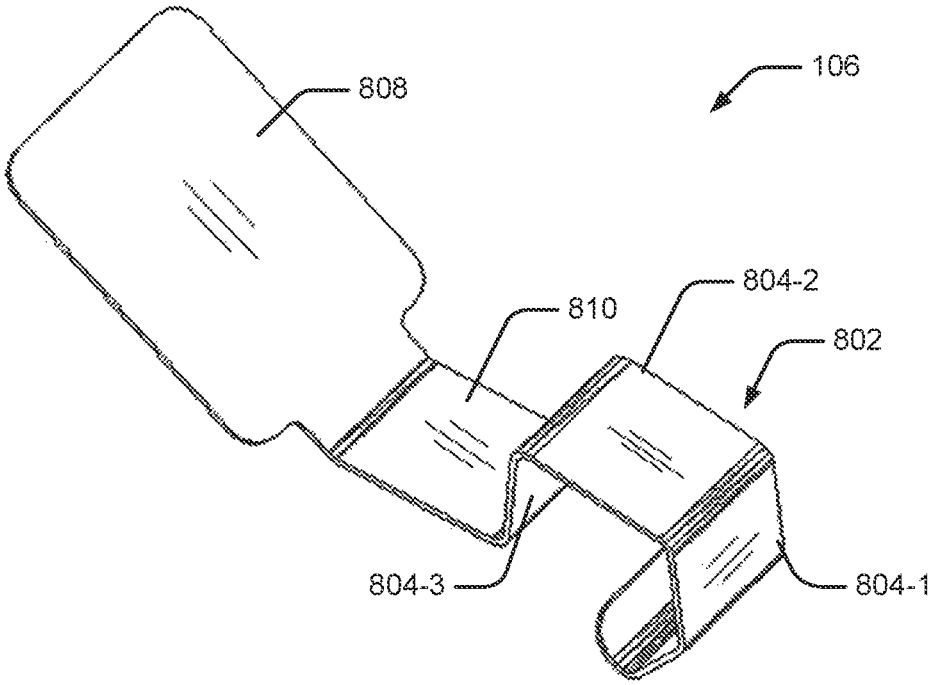
FIGS. 8-9 depict perspective and lateral views of an example spring kicker element.
Figure 9:
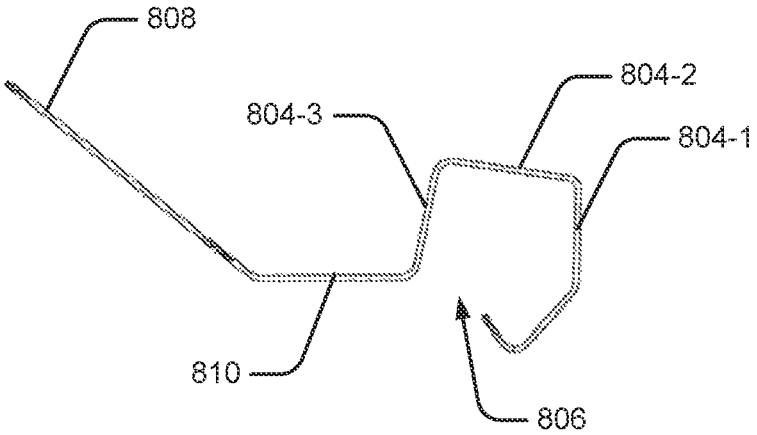

Additional constructional features of the spring kicker element(s) 106 are further described in conjunction with FIGS. 8-9, depicting such example spring kicker element(s) 106 in perspective and lateral views, respectively. As depicted in FIGS. 8-9, the spring kicker element(s) 106 comprises the clamping arrangement 802 as the base portion. The clamping arrangement 802 enables the spring kicker element(s) 106 to be fitted or installed on any kicker unit, such as the kicker unit(s) 104. The installation of the spring kicker element(s) 106 onto the kicker unit(s) 104 may be performed at the time of assembly (e.g., manufacturing of the print device). In another example, the spring kicker element(s) 106 is retrofittable and may be fitted onto the kicker unit(s) 104 within existing print devices, without affecting any changes in the internal mechanisms of such print devices.

Returning to the description of the spring kicker element(s) 106, the clamping arrangement 802 may further be realized through a series of planar walls 804-1, 804-2 and 804-3 (collectively referred to as walls 804). In the present example, the walls 804 are so adapted to form a concaved space 806, into which the kicker unit may be accommodated, when the spring kicker element(s) 106 is installed, thereupon. The shape and arrangement of the walls may be such that its shape is complementary to the shape of the portion of the kicker unit onto which it is installed. It should be noted that the walls 804 may form any shape without deviating from the scope of the present subject matter. In another example, the clamping arrangement 802 may further include grooves, interlocking constructs or fastening mechanisms which enable the snapping on of the spring kicker element(s) 106 onto the kicker unit.

The spring kicker element(s) 106 also includes the planar extension 808 which extends from the inner portion 810. The inner portion 810 joins the base portion (i.e., the clamping arrangement 802) of the spring kicker element(s) 106 and the planar extension 808. The planar extension 808 may be such that it extends in a plane which is different from the plane of the inner portion 810. In one example, the inclination between the planar extension 808 and the inner portion 810 may depend on the thickness of the media stack that is to be processed by the print device under consideration. For example, the inclination formed between the planar extension 808 and the inner portion 810 may be less for print device adapted to handle larger media stacks, whereas the angle may be greater for print device adapted to handle thinner media stacks. As would be understood, the angle between the inner portion 810 and planar extension 808 determines the reach of the spring kicker element(s) 106 fitted onto the kicker unit. Therefore, for greater separation between the position of the kicker unit with respect to the separator plate, a spring kicker element(s) 106 may be selected which has a lower angle between the inner portion 810 and the planar extension 808.

Figure 12:
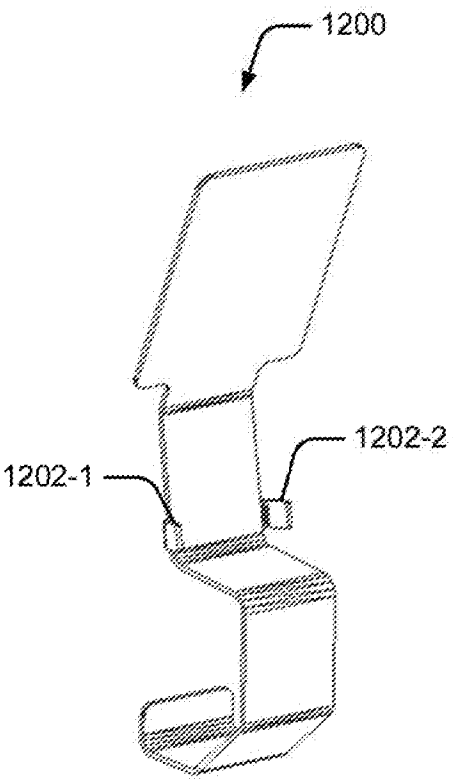
FIGS. 10-12 depict other example implementations of a spring kicker element.
Figure 11:
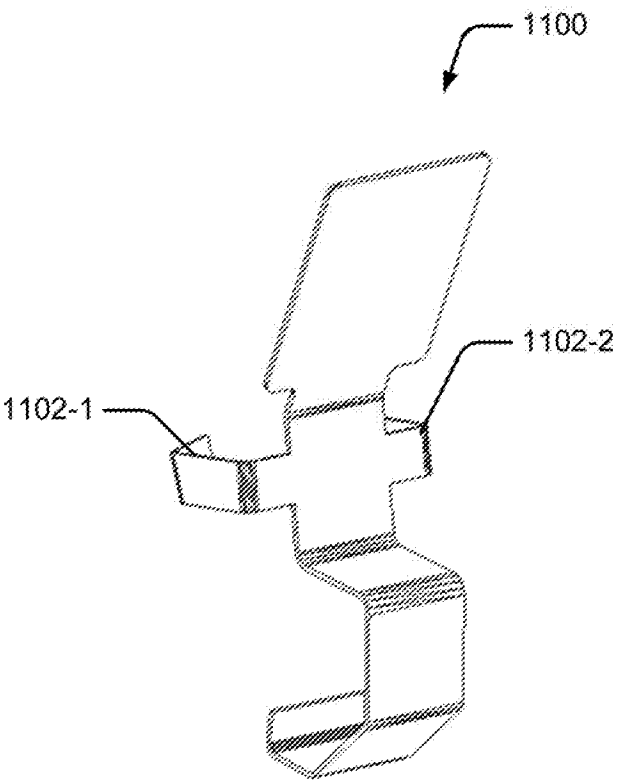
Figure 10:
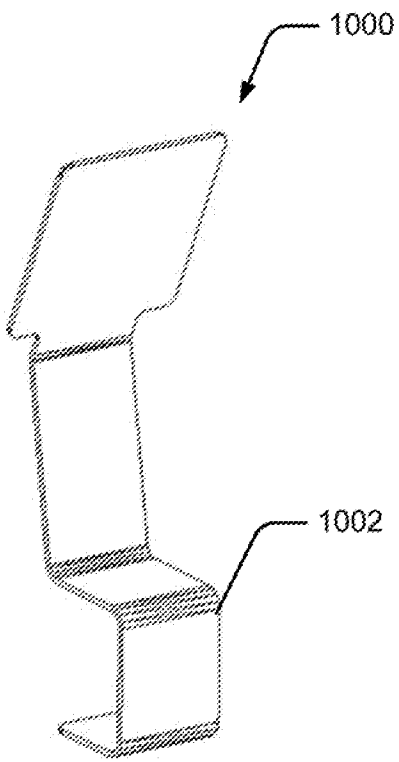

FIGS. 10-12 depict additional examples of the spring kicker element(s) 106. These examples, and the example depicted in FIG. 9 are merely illustrative. Other shapes and design variants of the spring kicker element(s) 106 and the kicker unit(s) 104 as well, may be possible without deviating from the scope of the present subject matter. FIG. 10 depicts an example spring kicker element(s) 1000 with a based portion 1002 as illustrated. FIG. 11 depicts another example spring kicker element(s) 1100. The spring kicker element(s) 1100 includes clamping arm 1102-1 and arm 1102-2 (collectively referred to as the arms 1102). The arms 1102 may aid in providing additional support to supplement the clamping arrangement (such as the clamping arrangement 802). A yet another example spring kicker element(s) 1200 is illustrated in FIG. 12. The spring kicker element(s) 1200 may further include protrusion 1202-1 and protrusion 1202-2. In one example, the protrusion 1202-1 and protrusion 1202-2 may be used for affecting the fitting of the spring kicker element(s) 1200 onto the kicker unit(s) 104.

Figure 13:
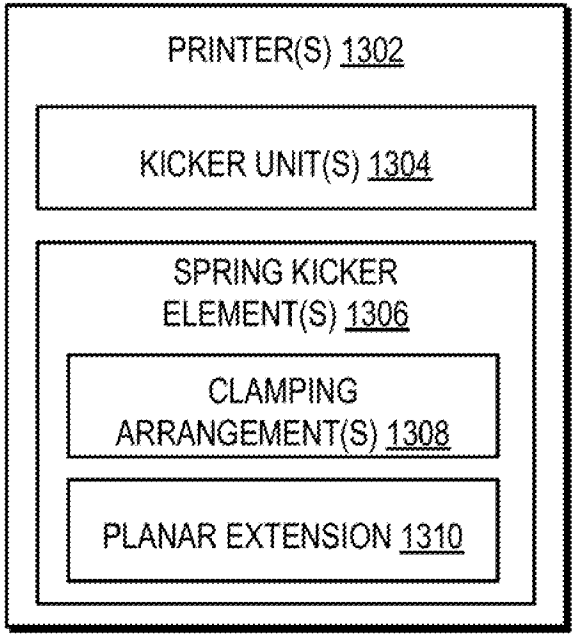
FIG. 13 is a block diagram of a printer, as per an example of the present subject matter.

FIG. 13 depicts a block diagram of an example printer(s) 1302. The printer(s) 1302 may further include a kicker unit(s) 1304. The kicker unit(s) 1304 is pivotable about an axis. The kicker unit(s) 1304 is with an arm which radially extends away from the axis. The printer(s) 1302 may further include a spring kicker element(s) 1306. The spring kicker element(s) 1306 is with a clamping arrangement 1308 and a planar extension 1310 (such as the planar extension 312). The clamping arrangement 1308 enables the coupling of the spring kicker element coupled to the kicker unit(s) 1304. The clamping arrangement 1308 is such that it allows to removably couple the spring kicker element(s) 1306 onto the kicker unit(s) 1304 of the printer(s) 1302. Continuing with the spring kicker element(s) 1306, the planar extension 1310 extends radially from the clamping arrangement 1308. As it extends, the planar extension 1310 is so oriented with respect to the clamping arrangement 1308, such that the planar extension 1310 extends away from kicker unit(s) 1304 upon the spring kicker element(s) 1306 being coupled with the kicker unit(s) 1304.

The kicker unit(s) 1304 is with a base portion and an arm. The arm is such that it radially extends from its base. The base of the kicker unit(s) 1304 is such that it is located about an axis about which the kicker unit is to pivot. In operation, the kicker unit(s) 1304 and the spring kicker element(s) 1306 may move and push the media edge of the next print medium which may have been disturbed. Once the print medium is pushed, it subtends an angle (referred to as the separator angle).

Although examples for the present disclosure have been described in language specific to structural features and/or methods, it should be understood that the appended claims are not necessarily limited to the specific features or methods described. Rather, the specific features and methods are disclosed and explained as examples of the present disclosure.

The invention claimed is:

1. An imaging device comprising:

a kicker unit pivotably attached within the imaging device, the kicker unit further comprising an arm radially extending from a center portion located about an axis, about which the kicker unit is to pivot; and a spring kicker element fitted onto the kicker unit, the spring kicker element comprising a planar extension extending radially away from the arm from a same point along the axis as the arm.

2. The imaging device as claimed in claim 1, wherein the spring kicker element is composed of an elastic material.

3. The imaging device as claimed in claim 1, wherein the spring kicker element comprises a series of planar walls forming a concave space complementary to the kicker unit, wherein the series of planar walls couple the spring kicker element onto the kicker unit.

4. The imaging device as claimed in claim 3, wherein the spring kicker element is fitted onto the center portion of the kicker unit by the series of planar walls.

5. The imaging device as claimed in claim 1, wherein the planar extension comprises an engaging surface, with the engaging surface to contact a surface of a print medium stored within the imaging device.

6. The imaging device as claimed in claim 1, further comprising a cam shaft, wherein the kicker unit fitted with the spring kicker element is mounted onto the cam shaft.

7. A print device comprising:

a cam shaft;

a kicker unit pivotably mounted on the cam shaft, the kicker unit further comprising an arm radially extending from a center portion located about an axis of the cam shaft, wherein the kicker unit is moveable between an engaging position and a non-engaging position; and a spring kicker element fitted onto the kicker unit, the spring kicker element comprising a planar extension extending radially away from the arm from a same point along the axis as the arm.

8. The print device as claimed in claim 7, wherein the spring kicker element is to contact a surface of a media stack when the kicker unit moves from the non-engaging position to the engaging position.

9. The print device as claimed in claim 8, wherein spring kicker element is to maintain a leading edge of a print medium at a predefined angle with respect to a separator plate onto which the media stack, abuts.

10. The print device as claimed in claim 7, wherein when the kicker unit is in the non-engaging position, the spring kicker element is in a non-compressed state.

11. The print device as claimed in claim 7, wherein when the kicker unit is in the engaging position, the spring kicker element is between a compressed state and a non-compressed state, depending on thickness of the media stack.

12. The print device as claimed in claim 7, wherein the planar extension comprises an engaging surface to contact a surface of a print medium in the media stack.

13. The print device as claimed in claim 7, wherein the spring kicker element is composed of an elastic material.

14. The print device as claimed in claim 7, wherein the spring kicker element comprises a series of planar walls forming a concave space complementary to the kicker unit, wherein the series of planar walls removably couple the spring kicker element onto the kicker unit.

15. A printer comprising:

a kicker unit pivotable about an axis, the kicker unit further comprising an arm radially extending away from the axis;

a spring kicker element comprising a series of planar walls and a planar extension, with the spring kicker element coupled to the kicker unit, wherein:

the series of planar walls form a concave space complementary to the center portion of the kicker unit and removably couple the spring kicker element onto the kicker unit of the printer; and the planar extension extends radially from the clamping arrangement, wherein the planar extension is so oriented with respect to the clamping arrangement such that the planar extension extends away from kicker unit upon the spring kicker element being coupled with the kicker unit.

16. The printer as claimed in claim 15, wherein the kicker unit further comprises grooves positioning the kicker unit within the printer.

17. The printer as claimed in claim 15, wherein the spring kicker element further comprises a clamping arm to couple the spring kicker element onto the kicker unit.

18. The printer as claimed in claim 15, wherein the spring kicker element further comprises a protrusion to fit the spring kicker element onto the kicker unit.

19. The printer as claimed in claim 15, wherein the planar extension is a leaf spring.

* * * * *